US009440121B2

(12) United States Patent
Deng et al.

(10) Patent No.: US 9,440,121 B2
(45) **Date of Patent: *Sep. 13, 2016**

(54) COATED GOLF CLUB HEAD/COMPONENT

(71) Applicant: Taylor Made Golf Company, Inc., Carlsbad, CA (US)

(72) Inventors: Xinhui Deng, Carlsbad, CA (US); Abram Stanley Harris, Vista, CA (US)

(73) Assignee: TAYLOR MADE GOLF COMPANY, INC., Carlsbad, CA (US)

( * ) Notice: Subject to any disclaimer, the term of this patent is extended or adjusted under 35 U.S.C. 154(b) by 390 days.

This patent is subject to a terminal disclaimer.

(21) Appl. No.: 14/108,080

(22) Filed: Dec. 16, 2013

(65) Prior Publication Data

US 2014/0100052 A1 Apr. 10, 2014

Related U.S. Application Data

(63) Continuation of application No. 11/749,723, filed on May 16, 2007, now Pat. No. 8,608,592.

(51) Int. Cl.

| | |
|---|---|
| ***A63B 53/00*** | (2015.01) |
| ***C23C 28/00*** | (2006.01) |
| *A63B 53/04* | (2015.01) |

(52) U.S. Cl.

CPC ..... *A63B 53/00* (2013.01); *A63B 53/047* (2013.01); *C23C 28/00* (2013.01); *C23C 28/321* (2013.01); *C23C 28/322* (2013.01); *C23C 28/341* (2013.01); *C23C 28/347* (2013.01); *A63B 53/04* (2013.01); *A63B 53/0487* (2013.01); *A63B 2053/042* (2013.01); *A63B 2053/0408* (2013.01); *A63B 2053/0416* (2013.01); *A63B 2053/0425* (2013.01); *A63B 2209/00* (2013.01)

(58) Field of Classification Search

USPC ..... 473/349, 345, 282, 324, 330, 340

See application file for complete search history.

(56) References Cited

U.S. PATENT DOCUMENTS

| | | | | |
|---|---|---|---|---|
| 3,656,995 | A * | 4/1972 | Reedy, Jr. | C23C 16/0218 148/218 |
| 3,754,968 | A * | 8/1973 | Reznik | B22F 7/04 427/369 |
| 3,784,402 | A * | 1/1974 | Reedy, Jr. | C23C 16/0218 148/240 |
| 3,807,008 | A * | 4/1974 | Reedy, Jr. | C23C 16/0272 148/278 |
| 3,951,612 | A * | 4/1976 | Gates | C23C 16/32 416/241 B |

(Continued)

FOREIGN PATENT DOCUMENTS

| | | |
|---|---|---|
| JP | 10-000250 | 1/1998 |
| JP | 11004920 | 1/1999 |

*Primary Examiner* — Gene Kim
*Assistant Examiner* — Matthew B Stanczak
(74) *Attorney, Agent, or Firm* — Klarquist Sparkman, LLP

(57) ABSTRACT

A golf club component, such as a golf club head and/or a golf club shaft, can comprise a golf club component substrate having an outer layer of titanium carbide, typically comprising at least forty percent (40%) carbon content. Alternatively, a golf club component can comprise a golf club component substrate, at least a portion of which is enveloped by a first coating layer of, for example, electroplated nickel, a second coating layer of, for example, electroplated chromium or palladium, and a third coating layer of titanium carbide applied by physical vapor deposition. The titanium carbide layer is durable and can provide the golf club component with a desired aesthetic appearance, such as a black color. Additionally, the golf club component can be coated with a fourth coating layer, such as a layer comprising a sealant or clear coat material.

6 Claims, 1 Drawing Sheet

(56) References Cited

U.S. PATENT DOCUMENTS 3,999,954 A * 12/1976 Kolaska ..... C22C 29/00 419/15
4,092,156 A * 5/1978 Kobayashi ..... C22C 29/10 419/15
4,150,195 A * 4/1979 Tobioka ..... B22F 7/04 419/13
4,305,998 A * 12/1981 Manty ..... B32B 15/01 428/660
4,919,773 A * 4/1990 Naik ..... C23C 28/00 204/192.15
5,207,427 A 5/1993 Saeki
5,252,360 A 10/1993 Huttl et al.
5,458,334 A 10/1995 Sheldon et al.
5,531,444 A * 7/1996 Buettner ..... A63B 53/04 473/349
5,603,667 A * 2/1997 Ezaki ..... A63B 53/04 473/324
5,667,904 A 9/1997 Moysan et al.
5,674,562 A * 10/1997 Claar ..... C04B 35/652 419/12
5,814,415 A 9/1998 Moysan et al.
5,948,548 A 9/1999 Welty et al.
5,952,111 A 9/1999 Sugg et al.
5,985,468 A 11/1999 Sugg et al.
6,088,947 A * 7/2000 Suzue ..... A01K 87/00 280/819
6,129,994 A * 10/2000 Harada ..... C23C 4/02 427/376.2
6,196,936 B1 * 3/2001 Meckel ..... A45D 29/00 204/192.38
6,723,279 B1 4/2004 Withers et al.
7,025,694 B2 4/2006 Huang
8,608,592 B2 * 12/2013 Deng ..... A63B 53/047 473/282
2003/0113590 A1 6/2003 Chen
2004/0101708 A1 5/2004 Chen
2005/0130761 A1 6/2005 Vokey et al.
2006/0289088 A1 12/2006 Bruce et al.
2008/0287215 A1 * 11/2008 Deng ..... A63B 53/047 473/349

* cited by examiner

COATED GOLF CLUB HEAD/COMPONENT

CROSS REFERENCE TO RELATED APPLICATION

This application is a continuation of U.S. patent application Ser. No. 11/749,723, filed May 16, 2007, which is incorporated herein by reference.

FIELD

The present disclosure concerns coated golf club components.

BACKGROUND

Current golf club shafts are made of metals or composite materials, and golf club heads are made of metals or metal alloys, such as stainless steel or titanium alloys. The golf club head is subject to large forces during impact with golf balls, which can decrease a golf club's period of usefulness if the components are not durable enough to withstand these forces.

Paint can protect golf club components from corrosion, but generally does not adhere well to titanium alloys. Even when a clear sealing coat is applied on top of the paint, the paint on a golf club head is not very durable and can be quickly chipped away by golf ball impacts.

Several U.S. patents disclose coated golf club components with the purpose of increasing component durability. For example, U.S. Pat. No. 5,458,334 to Sheldon, et al. discloses a golf club face "with a substantially harder material fused to it," where "the resulting clubface is a homogenous, hard material." The process disclosed in Sheldon involves a "micro-welding process" and "is not a coating process." "Especially useful for the electrode [used in the micro-welding process] are the carbides of various metals such as tungsten carbide, titanium carbide, chromium carbide and other well-known metallic carbides." Sheldon does not disclose a coated golf club component, but rather, a single homogenous fused layer of golf club component substrate and electrode material.

U.S. Pat. No. 6,723,279 to Withers, et al. discloses that a golf club component "may also be surface hardened . . . preferably by coating a titanium golf club structure with fullerenes and heat treating the coated structure to produce a titanium carbide surface." "The important discovery is that the buckyballs provide an alloying bridge to the steel or titanium golf club surface and produces a carbide alloy surface that can be quite hard." Similar to Sheldon, Withers discloses a surface layer of titanium carbide, directly fused to the golf club component substrate.

U.S. Pat. No. 6,196,936 to Meckel discloses a golf club component that "is coated with a corrosion-resistant, wear-resistant, impact-resistant material, such as zirconium nitride, titanium nitride, di-titanium nitride, titanium aluminum nitride, titanium carbonitride, titanium zirconium nitride, or titanium aluminum carbonitride." In Meckel, "each layer is substantially homogenous and of uniform composition throughout," and "in all cases, the total thickness of the coating 130, for the total of all the layers, is preferably from about 1½ to about 10 micrometers." The coated golf club components disclosed in Meckel can be colorful, ranging from pink to "nearly black."

Based on a machine translation, Japanese Patent Application No. 09-173114 (publication no. 11-004920) to Yoshinobu, et al. discloses a golf club head having a "flame-spraying layer of cemented carbide in the front face of the golf club head body formed with the metallic material which uses titanium as a principal component, and forming on it the coating layer which consists of a hard titanium compound." In Yoshinobu, the preferred thickness of the titanium carbide coating layer "is several microns thru/or dozens of microns." In Yoshinobu, a "beautiful" gray is obtained on the front face of the golf club head.

Also based on a machine translation, Japanese Patent Application No. 08-175818 (publication no. 10-000250) to Naoyuki, et al. discloses a golf club head having a surface preparation layer consisting of an "inner layer which uses titanium nitride (TiN) or titanium carbide (TiC) as a principal component" and an "outer layer which uses carbonization titanium nitride (TiCN) as a principal component." The inner layer of titanium nitride or titanium carbide has a thickness of about "1.2 micrometers-4.5 micrometers." Naoyuki praises homogenous coating layers because "[they excel] in the stability of a color tone. For example . . . gray becomes possible with titanium carbide (TiC)."

These and other coated golf club components have been developed, although none of these prior known golf club components is ideal. For example, conventional plating techniques do not provide wear resistance, and conventional physical vapor deposition techniques do not provide corrosion resistance for golf club components. Furthermore, golf club components having an aesthetically pleasing black color generally cannot be produced by conventional plating, conventional physical vapor deposition, nor the prior art methods disclosed above. Thus there is a need for an improved approach to protecting golf club components that can produce both an aesthetically pleasing appearance, such as a black color, and also function to prevent or substantially reduce corrosion and/or wear of the golf club component.

SUMMARY

A golf club component, such as a golf club head or a golf club shaft, can comprise one or more coating layers of material in addition to the substrate material used to make the golf club component itself. These coating layers can provide desired physical properties, such as a hard, durable, wear-resistant, and corrosion-resistant surface, as well as desired aesthetic traits, such as a black appearance. A coating layer coats at least a portion of the golf club component substrate surface, typically the entire substrate surface, and in some embodiments substantially envelops the golf club component. For example, in one embodiment, at least a portion of a golf club component substrate can be coated with a surface layer comprising a metal or metal alloy, which gives the golf club component an aesthetically pleasing black appearance.

To facilitate protection of golf club components, one embodiment of a disclosed golf club component comprises a golf club component substrate, a first coating layer, a second coating layer, and a third coating layer comprising titanium carbide. The golf club component substrate can comprise any material now known or subsequently developed that is useful for forming the substrate, such as iron or iron alloys, including stainless steels, or non-ferrous materials, such as titanium or titanium alloys.

In some embodiments, the first coating layer can provide rust protection for the golf club component. Additionally, the first coating layer can fill any microporosity in the golf club component, and can smooth surface roughness from sand blasting or shot peening during manufacture. Thus, the first coating layer can comprise any material suitable for preventing rust on the golf club component and/or for smoothing the component surface, and typically comprises nickel or a nickel alloy. A first coating layer comprising nickel or a nickel alloy can, for example, be electroplated on the golf club component substrate, and can have any thickness suitable to perform the above mentioned functions, typically having a thickness of from about 5 μm to about 30 μm, preferably having a thickness of from about 15 μm to about 25 μm.

Additionally, in some embodiments, an optional layer of copper or a copper alloy can be used. For example, a copper or copper alloy may be applied, such as by electroplating on the golf club component before the first coating layer, without affecting the results. Copper can provide several property and/or processing benefits. For example, a copper layer having a thickness of from about 1 μm to about 2 μm can increase surface conductivity, thereby facilitating improved electroplating consistency.

In some embodiments, the second coating layer can facilitate bonding between the first coating layer and the third coating layer. One reason for this is that the residual stress of the third coating layer can be much higher than that of the first. Additionally, the second coating layer can support and enhance glossiness in the finish. Thus, the second coating layer can comprise any material suitable for making a golf club component, such as to facilitate bonding between coating layers and/or for enhancing glossiness. The second coating layer typically comprises chromium or a chromium alloy. Alternatively, in some embodiments, the second coating layer can comprise palladium or a palladium alloy instead of chromium. A second coating layer can, for example, be electroplated on to the gold club component, and may coat at least a portion of the first coating layer, and can have any thickness suitable to perform the above mentioned functions. A second coating layer typically has a thickness of from greater than zero μm up to about 10 μm, more typically from about 1 μm to about 7 μm, and preferably having a thickness of from about 1 μm to about 3 μm. As yet another alternative, both a chromium or chromium alloy layer and a palladium or a palladium alloy can be used together.

In some embodiments, a third coating layer of titanium carbide can give the golf club component a black appearance. This black color can be accomplished by using a titanium carbide layer comprising a high proportion of carbon. The proportion of carbon used is best determined by considering the functional requirements of this layer, as well as the aesthetic appearance. Currently, a carbon content of at least about forty percent (40%) seems desirable, with the range typically being from about forty percent (40%) by weight up to about seventy percent (70%) by weight. The finish of the third coating layer can be altered to provide the desired physical properties or appearance. For many embodiments, the desired finish is glossy or shiny. Other finishes also are possible, including a matte finish, a satin finish, a brushed metal finish, or a finish created by a physical process, such as a blasting process that can be accomplished using glass beads, shot peen, aluminum oxide, etc.

In addition, some portions of a coated golf club component can have areas with different finishes. For example, the coating layers described can be used to create a golf club component having a glossy black appearance on the bottom of the component, while at the same time having a matte black finish on other surfaces of the component, such as to reduce glare for the user. This can be accomplished by applying the coating layers over areas of the component with different surface roughnesses, thereby producing a golf club component with different finishes in different areas.

A third coating layer of titanium carbide can be applied using any suitable method, such as physical vapor deposition, including magnetron sputtering, cathodic arc, and other thin film deposition methods. Titanium can be first deposited from a titanium target, and then carbon can be deposited in gradually increasing proportions from a carbon source, such as acetylene or methane gas. A third coating layer comprising titanium carbide can have any thickness suitable for golf club component durability and which provides the desired aesthetic result, such as a pleasing black appearance. The third layer typically has a thickness of from greater than zero μm to at least about 1 μm, more typically from about 0.5 μm to about 1 μm, and preferably the third layer has a thickness of from about 0.8 μm to about 1 μm. If the layer is too thick, then residual stress may be too high and layer adhesion poor.

In some embodiments, the third coating layer may have a non-homogenous structure. For example, a portion of the third coating layer closest to the second coating layer may contain virtually no carbon to a substantial carbon content, i.e. this portion may have a carbon content of from 0% to about 50%. Moreover, the carbon percentage gradually may increase throughout the thickness of the third coating layer, resulting in a carbon content at the outer surface of the third coating layer that varies from about 40% to about 70%, with working embodiments having an average carbon content at the outer surface of about 50%.

In some embodiments, the golf club component additionally can comprise other layers of material, such as a sealant or a clear sealing coat material on a portion of or completely surrounding the third coating layer. Furthermore, in some embodiments, each coating layer may either envelop substantially all of the golf club component, or it may coat only a portion of the golf club component.

The foregoing and other objects, features, and advantages of the invention will become more apparent from the following detailed description, which proceeds with reference to the accompanying figures.

DETAILED DESCRIPTION

Figure 1:
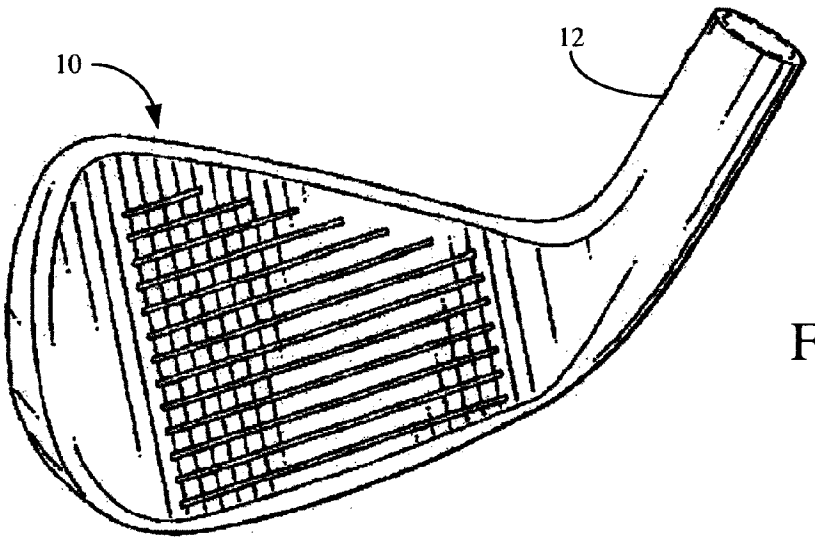
FIG. 1 is a perspective view depicting a golf club head and a portion of a golf club shaft.

FIG. 1 illustrates a portion of an iron comprising a golf club head 10 and a portion of golf club shaft 12 extending from head 10. FIG. 1 depicts an iron, but other types of golf clubs, such as putters and drivers, also can be made in accordance with this disclosure. The coating layers of the present disclosure are preferably applied to the entire golf club component, or in some embodiments, one or all of the layers may be coated only on selected portions of the golf club component or underlying coating layers.

Figure 2:
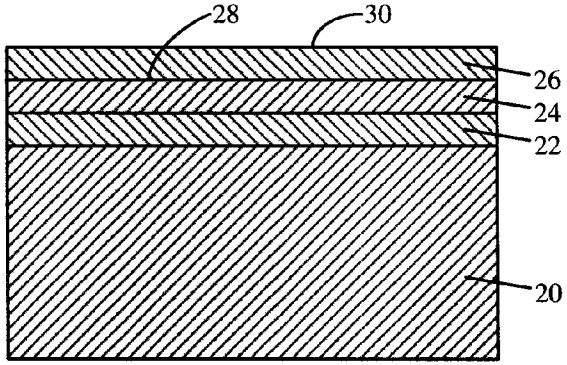
FIG. 2 is a cross sectional view of a golf club component having a substrate material, and a first, second, and third coating layer.

FIG. 2, which is not drawn to scale, is a cross sectional view of a golf club component substrate 20 having a first coating layer 22, a second coating layer 24, and a third coating layer 26. Golf club component substrate 20 can comprise any suitable material, such as a metal or metal alloy. Typical substrate materials include ferrous materials, particularly iron alloys, such as a stainless steel, or non-ferrous materials, such as titanium or titanium alloys.

In some embodiments, first coating layer 22 can protect substrate 20, as by providing rust protection for golf club component substrate 20. Moreover, investment casted or forged golf club components can contain pits or cracks in their outer surfaces. First coating layer 22 can fill this microporosity (not shown) in golf club component substrate 20, and can smooth surface roughness that results during processing, such as from sand blasting or shot peening during manufacture. First coating layer 22 can comprise nickel or nickel alloys, but other metals or metal alloys that successfully smooth out surface roughness in the golf club component can be used as well. First coating layer 22 can be applied by any suitable method. For example, first coating layer 22 can be electroplated to form a coating on golf club component substrate 20. First coating layer 22 may be substantially homogenous or non-homogenous throughout its thickness and can have any thickness suitable to perform the above mentioned functions. Certain embodiments have a thickness of from about 5 μm to about 30 μm, and preferably from about 15 μm to about 25 μm. First coating layer 22 can envelop substantially all of golf club component substrate 20. Alternatively, only a portion of golf component substrate 20 may include first coating layer 22.

In some embodiments, second coating layer 24 can facilitate bonding between first coating layer 22 and third coating layer 26 because the residual stress of third coating layer 26 can be much higher than that of first coating layer 22. Additionally, second coating layer 24 can support and enhance glossiness in the overall finish, if such glossiness is desired. Second coating layer 24 can be applied by any suitable method. Typically second coating layer 24 is applied by electroplating to form a coating on first coating layer 22, and possibly on portions of golf club component substrate 20. Second coating layer 24 may be substantially homogenous or non-homogenous throughout its thickness. Second coating layer 24 can envelop substantially all of first coating layer 22. Alternatively, only a portion of first coating layer 22 or golf club component substrate 20 may include second coating layer 24. Second coating layer 24 can have any thickness suitable to perform the above mentioned functions, and typically has a thickness of from greater than zero μm up to about 10 μm, more typically from about 1 μm to about 7 μm, and preferably has a thickness of from about 1 μm to about 3 μm. Second coating layer 24 can comprise, for example, chromium, a chromium alloy, palladium or a palladium alloy. Other metals or metal alloys also can be used, particularly those that successfully facilitate bonding between first coating layer 22 and third coating layer 26, or which enhance desired aesthetic properties, such as finish glossiness.

In typical embodiments, third coating layer 26 comprises titanium carbide. Third coating layer 26 can give golf club component substrate 20 an aesthetically pleasing black appearance, the finish of which can be quantified by surface reflectance. A third coating layer 26 comprising titanium carbide can have any thickness which is suitable for golf club component durability and/or which provides the desired aesthetic appearance. Third coating layer 26 can have a thickness of from greater than zero μm up to at least about 1 μm, typically has a thickness of from about 0.5 μm to about 5 μm, and preferably has a thickness of from about 0.8 μm to about 1 μm. The golf club component's overall appearance can depend on the percentage of carbon present in third coating layer 26. In some embodiments, third coating layer 26 comprises a high proportion of carbon, preferably about forty percent (40%) or greater. Third coating layer 26 preferably can comprise a high enough percentage of carbon to result in an aesthetically pleasing black color.

Disclosed golf club components can have different finishes. For example, the finish can appear glossy or shiny, or alternatively can appear matte. The coated golf club component also can have different finishes in different areas of the component. For example, by making a golf club component substrate 20 having areas of different surface roughness, a golf club component with different finishes in different areas can be achieved. If the desired finish is glossy or shiny, the reflectance can be controlled so as not to interfere with the golf club's overall functionality.

Solely by way of example, finish types can be classified based on reflectivity. For example, a polished or glossy surface typically has a reflectivity of from about 0.4-0.1. A non-reflective or matte finish typically has a reflectivity of about 1.6-0.8. A rougher substrate, having a more diffuse reflectivity, also may appear more like a matte finish, and depending on the light, also may appear to be black more than a less diffuse reflected light.

While a high percentage of carbon can provide the desired black color, if the percentage of carbon in third coating layer 26 is too high, the resulting golf club component coating can be too brittle to perform satisfactorily. Typically, a third coating layer 26 having more than about seventy percent (70%) carbon is too brittle to perform satisfactorily if third coating layer 26 impacts the golf ball. For example, if third coating layer 26 is too brittle, then adhesion to the other coating layers can be less than desirable or required for a particular application. For those portions, if any, of third coating layer 26 that do not contact the golf ball during normal use as a golf club, brittleness is less of a concern.

Third coating layer 26 preferably can be applied using physical vapor deposition. Titanium can be first deposited from a titanium target. Carbon is then deposited in gradually increasing proportions from a suitable carbon source, such as lower alkyl carbon compounds having ten or fewer carbon atoms, like acetylene or methane gas. Alternatively, third coating layer 26 can be applied using other suitable techniques known in the art, such as metal spray deposition.

In some embodiments, third coating layer 26 envelops substantially all of second coating layer 24, and possibly portions of first coating layer 22 and/or golf club component substrate 20. Alternatively, only a portion of second coating layer 24, first coating layer 22, and/or golf club component substrate 20 may include third coating layer 26.

Third coating layer 26 comprises inner surface 28 and outer surface 30. In some embodiments, third coating layer 26 may be compositionally non-homogenous throughout its cross section. For example, a portion of third coating layer 26 near inner surface 28 may contain virtually no carbon. The percentage of carbon may gradually increase throughout the thickness of third coating layer 26, resulting in the highest concentration of carbon at outer surface 30 of third coating layer 26. Adjusting the physical vapor deposition parameters can enable one of ordinary skill in the art to achieve this non-homogeneity in third coating layer 26.

Figure 3:
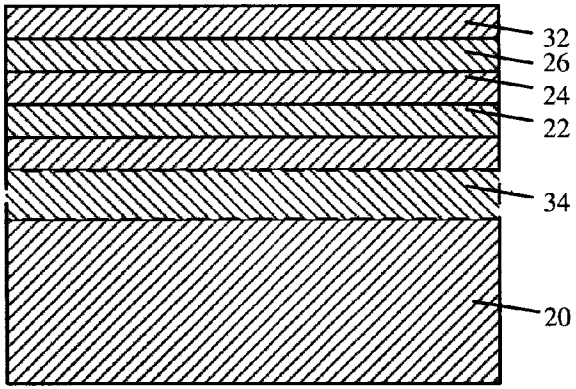
FIG. 3 is a cross sectional view of a golf club component having a substrate material, and a first, second, third, and fourth coating layer.

In some embodiments, disclosed golf club components can comprise one or more additional materials as illustrated by FIG. 3. FIG. 3, which is not drawn to scale, illustrates a golf club component substrate 20 leaving a first coating layer 22, a second coating layer 24, a third coating layer 26, a fourth coating layer 32 on third coating layer 26, and an optional layer 34. To the extent that references numbers in FIG. 3 are the same as reference numbers in FIG. 2, such elements are the same as described above. Fourth coating layer 32 can envelop substantially all of third coating layer 26. Alternatively, only a portion of third coating layer 26 may include fourth coating layer 32. Fourth coating layer 32 typically comprises a sealant or a clear coat material and can be applied by any suitable method including, for example, by being sprayed onto the underlying coating layers and/or golf club component. Fourth coating layer 32 typically has a thickness of from about 0.5 μm to about 2 μm. Fourth coating layer 32 can comprise, for example, Mirror-backing Thinner No. 281, a refined xylene produced by Peacock Laboratories, Inc., in Philadelphia, Pa.

Optional layer 34 can be coated on to at least a portion of golf club component substrate 20 as an initial step, before first coating layer 22. Optional layer 34 can comprise one or more materials, such as copper, copper alloys, nickel and/or nickel alloys. Optional layer 34 can be electroplated on a portion of or substantially the entire surface of golf club component substrate 20.

In view of the many possible embodiments to which the principles of the disclosed invention may be applied, it should be recognized that the illustrated embodiments are only preferred examples of the invention and should not be taken as limiting the scope of the invention. Rather, the scope of the invention is defined by the following claims. We therefore claim as our invention all that comes within the scope and spirit of these claims.

We claim:

1. A golf club component, comprising:

a golf club component substrate comprising iron, an iron alloy, titanium or a titanium alloy;

a first coating layer comprising nickel or a nickel alloy and having a layer thickness of from about 5 μm to about 30 μm;

a second coating layer comprising chromium or a chromium alloy and having a layer thickness of from about 1 μm to about 7 μm; and a third coating layer comprising titanium carbide having a sufficient amount of carbon to provide a black appearance and having a layer thickness of from about 0.5 μm to about 1 μm, wherein the third coating layer comprises at least about forty percent (40%) carbon by weight.

2. The golf club component according to claim 1, wherein the first coating layer has a thickness of from about 15 μm to about 25 μm.

3. The golf club component according to claim 1, wherein the second coating layer has a thickness of from about 1 μm to about 3 μm.

4. The golf club component according to claim 1, wherein the third coating layer comprises between about forty percent and seventy percent carbon by weight.

5. The golf club component according to claim 1, wherein the total thickness of the first, second, and third coating layers is at least 16 μm.

6. The golf club component according to claim 1, wherein at least two portions of the third coating layer have differing surface roughnesses such that the at least two portions have differing reflectivities, and wherein the at least two portions of the third coating layer comprise at least one matte portion and at least one glossy portion positioned to reduce glare for the user.

* * * * *